United States Patent [19]

Steigauf

[11] Patent Number: 4,519,536

[45] Date of Patent: May 28, 1985

[54] APPARATUS FOR DRIVING NAILS USING AN IMPACT HAMMER

[76] Inventor: William A. Steigauf, 400 - 7th S.W., Faribault, Minn. 55021

[21] Appl. No.: 585,203

[22] Filed: Mar. 1, 1984

[51] Int. Cl.[3] ..... B25C 5/13; B25C 7/00

[52] U.S. Cl. ..... 227/147; 227/149

[58] Field of Search ..... 173/34, 117; 227/130, 227/139, 140, 147, 149, 156

[56] References Cited

U.S. PATENT DOCUMENTS

| | | | |
|---|---|---|---|
| 1,164,086 | 12/1915 | Gooding | 227/113 |
| 1,539,894 | 6/1925 | Booth | 227/113 |
| 1,699,519 | 1/1929 | Brown | 227/147 |
| 2,187,692 | 1/1940 | Oeckl | 227/130 |
| 2,445,674 | 7/1948 | Kendall | 227/120 |
| 2,472,353 | 6/1949 | Van Sittert et al. | 227/147 |
| 2,543,942 | 3/1951 | Shaff | 227/147 |
| 2,605,466 | 8/1952 | Anderson | 227/113 |
| 2,671,216 | 3/1954 | Fox | 227/147 |
| 3,219,248 | 11/1965 | Krewson, Jr. | 227/147 |
| 3,485,307 | 12/1969 | Riley, Jr. et al. | 173/117 |
| 4,033,419 | 7/1977 | Pennington | 173/34 |
| 4,448,339 | 5/1984 | Pettigrew | 227/147 |

*Primary Examiner*—Paul A. Bell

*Attorney, Agent, or Firm*—Kinney & Lange

[57] ABSTRACT

An air-drive impact hammer is used to drive nails in locations where it is not possible to hold them in position with one hand and, using an ordinary hammer, drive them home using the other hand. A driver assembly has a driver shaft supported in the impact hammer, the front end surface of this shaft being a nail driving surface situated in perpendicular relationship to the longitudinal axis of the driver shaft. An intermediate ball keeper sleeve is concentrically and slidably mounted around the driver shaft, and an outer sleeve is concentrically and slidably mounted around the ball keeper sleeve. Four detaining ball receiving openings extend radially through the ball keeper sleeve on radial axes while lying in a common plane perpendicular to the longitudinal axis of the driver shaft. Nail head detaining balls are situated in each of the ball receiving openings.

18 Claims, 12 Drawing Figures

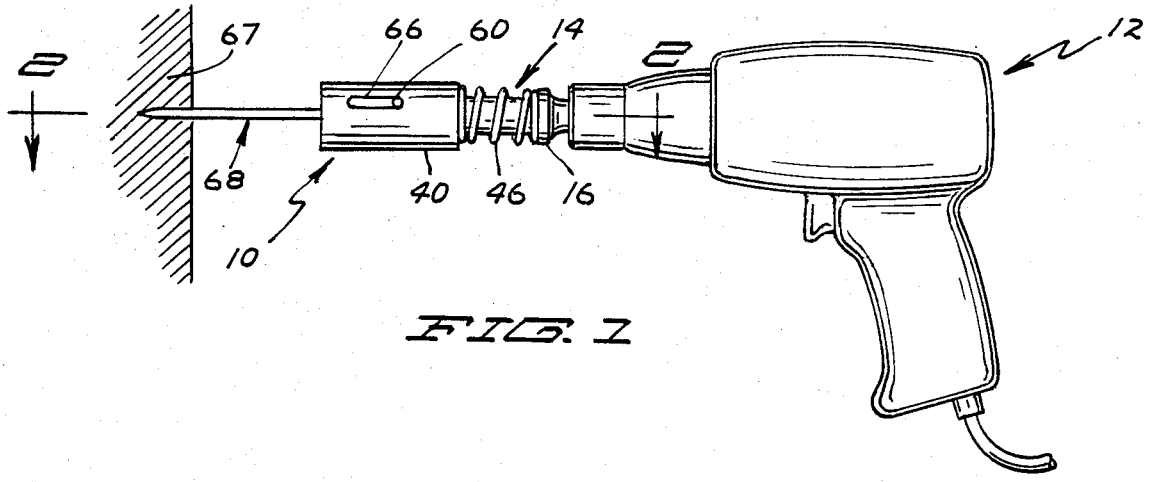
FIG. 1
FIG. 2
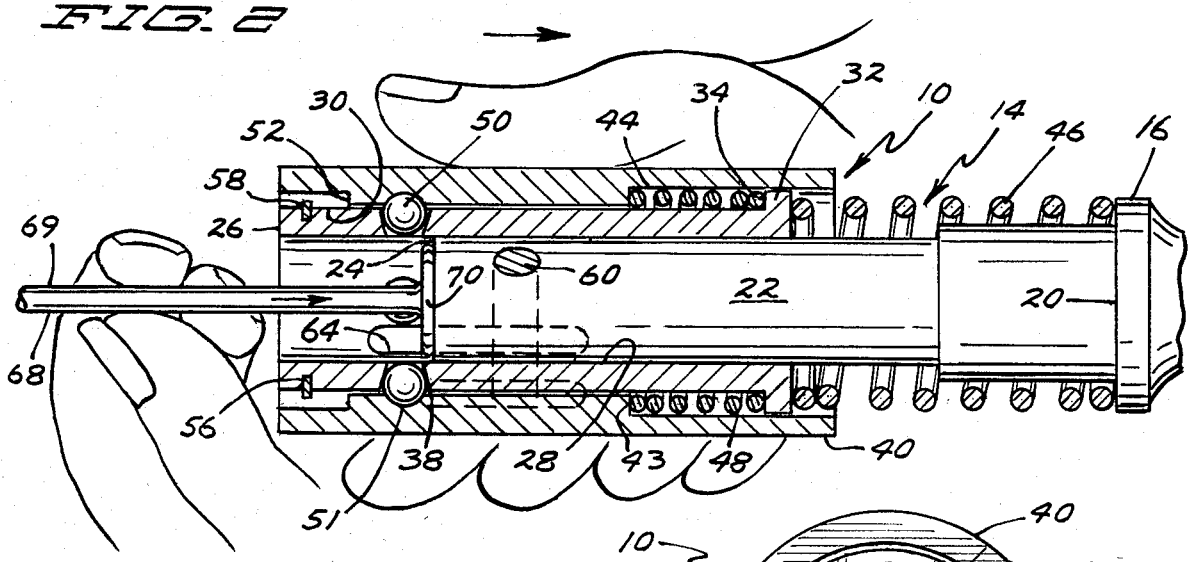
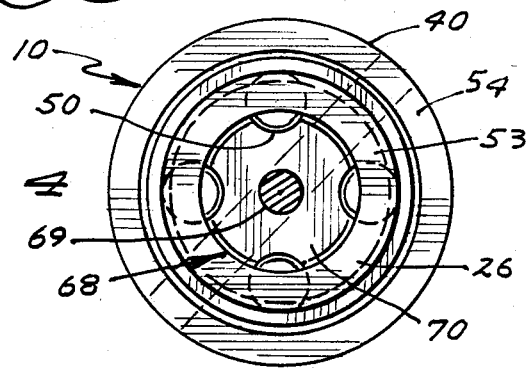
FIG. 4
FIG. 3
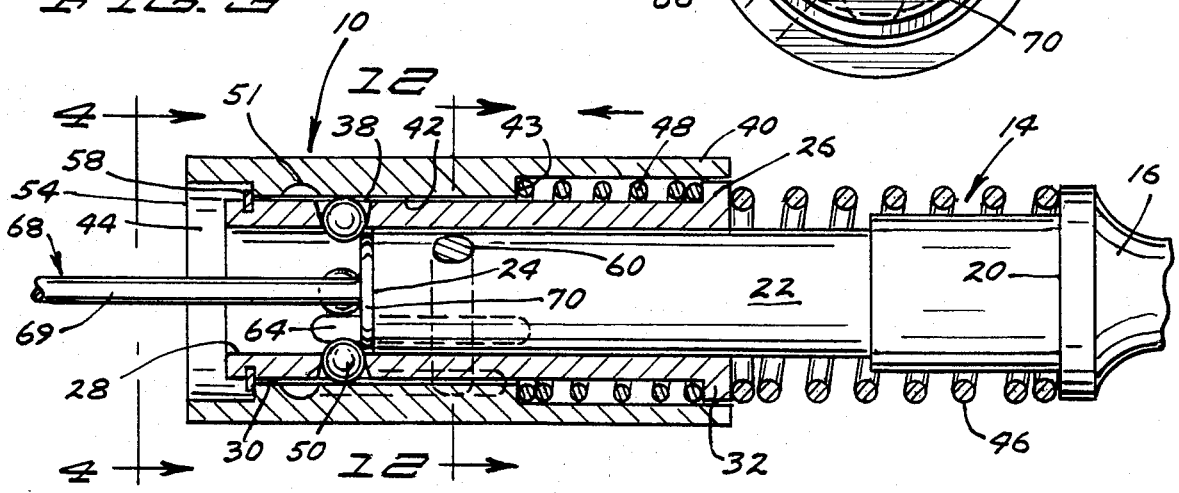

APPARATUS FOR DRIVING NAILS USING AN IMPACT HAMMER

BACKGROUND OF THE INVENTION

1. Field of the Invention.

This invention has relation to the use of impact hammers for impacting a driver assembly which can receive and hold the head of a nail and can, when the impact hammer is activated, drive that nail into a wooden board or the like.

2. Description of the Prior Art.

Power impact hammers and particularly air-drive impact hammers are well known, and are regularly used with various accessories to impact these accessories to operate on all kinds of materials. For example, short-barrel air impact hammers can deliver of up to in the neighborhood of 3500 hammer-action blows per minute. The description of the accessories normally used with such impact hammers gives some idea of the various jobs they are called upon to do. The accessories used include rivet cutters, pin punches, muffler splitters, pipe and panel cutters, cold chisels, and claw rippers.

It is known to drive metal pins into a rock face by supporting the pin in a cylinder which gives lateral support to the pin. The pin is driven into the rock by a combination of pressure and vibration at sonic frequencies applied longitudinally to the pin. See U.S. Pat. No. 4,033,419 to Pennington, granted in July of 1977.

The patent to Gooding, U.S. Pat. No. 1,164,086, granted in December of 1915, shows a magnetized plunger for holding a tack while a weighted tube including a hammer is brought down against the plunger to drive the tack home. A somewhat similar mechanism is employed in U.S. Pat. No. 1,539,894 to Booth, granted in June of 1925.

The patent to Riley et al, U.S. Pat. No. 3,485,307, shows a pistol grip hand tool of the prior art.

A pneumatic nail driver in which the nails being driven are dropped into a nail discharge tube or guide is shown in U.S. Pat. No. 2,445,674 to Kendall, granted in July of 1948. The guide includes a series of radially yielding fingers made of rubber or spring metal which hold the nail upright but which are pushed back out of the way by the driving force of the ram or hammer rod.

An automatic nail driving hammer operated by means of compressed air is shown in U.S. Pat. No. 2,187,692 to Oechl, granted in January of 1940. In this patent is disclosed a positioning of the nails by air into a nail centering bushing where an air driven piston drives a driver pin into the nail to drive it home.

U.S. Pat. No. 2,605,466 to Anderson, granted in August of 1952, shows an automatic tack hammer with a magnetic driver used to hold the tack until it is driven.

The foregoing are all of the patents cited in a search of a preliminary form of the present invention. Neither applicant nor those in privity with him are aware of any closer prior art or of any prior art which anticipates the claims herein.

SUMMARY OF THE INVENTION

A driver assembly receives and holds nails having flat heads of predetermined transverse dimension. The driver assembly includes a driver shaft operably associated with an impact hammer to receive and to transmit hammer-action blows from the hammer. The driver shaft includes an elongated hammer-engaging shank having a rear end portion supported in the impact hammer, and includes an elongated driver integrally connected to, extending forwardly from, and concentric with the shank, the driver having a nail driving surface at its front end, the nail driving surface being perpendicular to the longitudinal axis of the driver shaft.

An intermediate ball keepter sleeve is slidably mounted in encompassing relation to the driver, said ball keeper sleeve being partially defined by elongated, mutually parallel inner and outer surfaces. An outer sleeve is slidably mounted on the ball keeper sleeve, the outer sleeve being partially defined by an elongated inner surface parallel to, and in sliding contact with the ball keeper sleeve outer surface.

The ball keeper sleeve is provided with at least one detaining bolt receiving opening extending radially through it on a radial axis lying in perpendicular relation to and passing through the longitudinal axis of the driver shaft. A nail head detaining ball is situated in the ball receiving opening, the minimum dimension of the ball receiving opening being at the ball keeper sleeve inner surface and being less than the maximum transverse dimension of the ball therein.

The dimensions and configuration of the ball, the thickness of the ball keeper sleeve and the minimum dimension of the keeper sleeve ball receiving opening are such that the outermost surface of the ball will be substantially flush with the ball keeper sleeve outer surface and the innermost surface of the ball will lie on the periphery of an imaginary circle, concentric with the driver shaft, and of lesser diameter than the predetermined dimension of the heads of the nails to be held and driven when the ball protrudes as far as possible through the inner surface of the ball keeper sleeve.

The outer sleeve and the ball keeper sleeve are each partially defined by annular front end surfaces lying in planes perpendicular to the driver shaft axis, the outer sleeve being provided with at least one detaining ball receiving detent cavity open through its inner surface and positioned to be in alignment with the detent ball receiving opening in the ball keeper sleeve when the front end surfaces of the outer and the intermediate sleeves lie in a common plane. The size and configuration of the outer sleeve detent cavity is such that the detaining ball, when aligned with its detent cavity can be snugly fitted into the cavity to lie entirely outside of the ball keeper sleeve inner surface.

Bias means operative on the driver shaft and on the bolt keeper sleeve bias the bolt keeper sleeve to tend to move it along the driver in forward direction; and bias means is also provided to be operative on the outer sleeve and on the ball keeper sleeve to bias the outer sleeve to tend to move along the ball keeper sleeve in forward direction.

The specification herein refers to nails in the general sense to include any elongated flat headed nail or screw-like fastener which can be driven by repeated impact into a material to be fastened. Likewise, the term "ball" encompasses all elements serving like door bolts to prevent movement of the outer and intermediate sleeves with respect to each other, as is explained in detail in the specification which follows.

In a modified form of the invention, a driver sleeve is provided between the intermediate ball keeper sleeve and the driver and is free to slide with respect to the interior surface of the ball keeper sleeve and with respect to the outer surface of the driver. Following the driving of a nail with the modified form of driver assembly of the invention, means is provided to temporarily hold the driver sleeve against movement with respect to the ball keeper sleeve as the driver moves back and the ball keeper sleeve move forward under the influence of the bias means. Then when a nail head is inserted into the driver assembly, it is used to push the driver sleeve back and to thus get to position on the rear side of the detaining ball receiving opening in the ball keeper sleeve before the ball is forced into that opening under the force of the bias means as the detaining ball receiving detent cavity pushes the ball into nail head detaining relationship with respect to the nail.

BRIEF DESCRIPTION OF THE DRAWINGS

FIG. 1 is a side elevational view of an air impact hammer associated with a driver assembly of the present invention shown driving a nail into a wooden board which is shown in cross section;

FIG. 2 is an enlarged fragmentary horizontal sectional view taken on the line 2—2 in FIG. 1 of a driver assembly made according to a first form of the invention but showing it in position to receive a nail to be driven;

FIG. 3 is a fragmentary horizontal sectional view of the driver assembly of FIG. 2 but showing a nail being held in the driver assembly preparatory to being driven;

FIG. 4 is a further enlarged end elevational view taken on the line 4—4 in FIG. 3;

DETAILED DESCRIPTION OF THE PREFERRED EMBODIMENTS

First Form of the Invention

Figure 5:
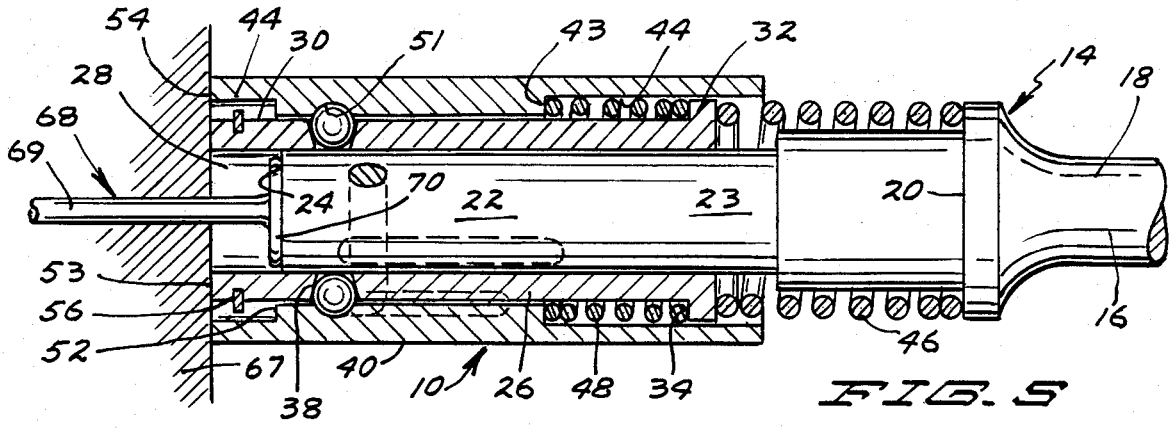
FIG. 5 is an enlarged fragmentary horizontal sectional view taken on the line 2—2 in FIG. 1 but showing the positioning of the parts after the driven nail has been released but as it is still being driven into the wood.

In a first form of the invention, as seen in FIGS. 1 through 4, a driver assembly 10 for holding and driving nails having heads of a first predetermined diameter is shown in FIG. 1 in association with an impact hammer shown herein as an air-impact hammer 12. The impact 12 can be of any usual or preferred construction, but an air-drive impact hammer such as sold by Sears, Roebuck & Co. as a CRAFTSMAN brand air-drive impact hammer as shown on page 103 of their 1981/1982 catalog of Power and Hand Tools, has been found to be satisfactory. Driver assembly 10 includes a driver shaft 14 which has an impact hammer-engaging shank 16 having a rear end portion 18 supported in impact hammer 12 to receive intermittent hammer-action blows from the hammer. Shank 16 is also provided with a forwardly facing inner spring-engaging shoulder 20.

Also part of the driver shaft 14 is a cylindrical driver 22, extending integrally and concentrically forwardly from the hammer-engaging shank 16. Driver 22 is partially bounded by an outer cylindrical surface 23, and by a flat nail-driving surface 24 at a front end thereof. This surface 24 lies in a plane perpendicular to the longitudinal axis of the driver shaft.

An intermediate ball keeper sleeve 26 is, in this first form of the invention, slidably mounted on the cylindrical driver 22. Intermediate sleeve 26 is partially defined by an inner cylindrical surface 28 slidably mounted directly on the driver in this form of the invention, and an outer cylindrical surface 30, concentric with the inner surface 28. An intermediate sleeve collar 32 extends outwardly from a rear end portion of the intermediate ball keeper sleever 26, and provides a forwardly facing shoulder 34. Intermediate ball keeper sleeve 26 is also provided with at least one detaining ball receiving opening extending radially through it. In the form of the invention as shown, there are four such ball receiving openings 38, the axes of each of these openings lying on a radius extending outwardly from the longitudinal axis of the driver shaft, all of these axes of these ball receiving openings lying in a single plane perpendicular to this longitudinal driver shaft axis.

An outer cylindrical sleeve 40 of the driver assembly 10 is partially defined by an inner cylindrical surface 42 in concentric sliding contact with the ball keeper sleeve outer cylindrical surface 30. A rearwardly facing shoulder 43 extends outwardly of the inner cylindrical surface 42 at an intermediate portion of the outer cylindrical sleeve 40 to join an intermediate cylindrical surface 44 of the sleeve 40 which extends to the rear end of sleeve 40.

An inner compression coil spring 46 surrounds the driver 22 and bears against the forwardly facing shoulder 20 of the impact hammer-engaging shank 16 and the rear end of the intermediate ball keeper sleeve 26 to tend to move the ball keeper sleeve in forward direction.

An outer compression coil spring 48 extends around the ball keeper sleeve 26 between the rearwardly facing shoulder 43 of the outer cylindrical sleeve 40 and the forwardly facing shoulder 34 of the ball keeper sleeve collar 32, and bears against those faces to tend to move the outer cylindrical sleeve 40 in forward direction.

In both forms of the invention as shown, four spherical nail head detaining balls or bolts 50 are situated, one in each of the detaining ball receiving openings 38. As perhaps best seen in FIG. 3, the minimum diameter of the ball receiving openings 38 is at the inner cylindrical surface 28 of the ball keeper sleeve 26, and it is less than the diameter of the balls 50 so that when the balls extend past this inner cylindrical surface 28 to their maximum extent, they come into detaining relationship to the driver 22. Also as best seen in FIG. 3, the thickness of the sleeve 26, the diameter of the balls 50, and the minimum diameter of the ball receiving openings 38 is such that when the balls are at their maximum penetration through inner surface 28 of the intermediate ball keeper sleeve 26, they are just flush with the outer cylindrical surface 30 of the sleeve 26 and are in contact with the inner cylindrical surface 42 of the outer cylindrical sleeve 40.

Ball keeper sleeve 26 and outer sleeve 40 are also partially defined by flat, annular front end surfaces 53 and 54, respectively, each such surface lying in a plane at right angles to the axis of the driver shaft 14. Outer sleeve 40 is provided with four detaining ball receiving detent cavities 51 open through the inner cylindrical surface 42 of the outer sleeve and positioned to be in alignment with the ball receiving openings 38 when the front end surface 53 of the ball keeper sleeve 26 and the front end surface 54 of the outer sleeve 40 lie in the same plane. The size and configuration of these detent cavities 51 is such as to completely and snugly encompass that portion of the detaining balls 50 when the innermost portions of the balls are entirely within the ball keeper sleeve and tangent to the inner cylindrical surface 28 of that sleeve.

In each of the forms of the invention illustrated and described herein, the nail head detaining balls 50 serve as bolts similar to door bolts in that they slide back and forth through the detaining ball receiving openings 38 in the ball keeper sleeve 26, into and out of nail head detaining, restraining or fastening relationship with the heads of the nails to be held and driven, and into and out of detent cavities 51 in a manner similar to the operation of a bolt on a door. Therefore, although the specification refers to nail head detaining balls 50 throughout, it is to be understood that it encompasses bolts which are not spherical. For example, should it be desirable to constitute the intermediate ball keeper ring as having thicker walls to accommodate nail heads of a second predetermined diameter, elongated bolts with semi-spherical or cone-shaped ends would function in the same manner as the spherical balls.

A forward portion of the outer cylindrical sleeve 40 is provided with a forwardly facing shoulder 52 which extends outwardly from the inner cylindrical surface 42 at a forward portion of that sleeve to meet with a forward extension of the intermediate cylindrical surface 44 thereof.

A snap ring retaining groove 56 is provided in a forward portion of the intermediate ball keeper sleeve 26, and a snap ring 58 in that groove is in position to bear against forwardly facing shoulder 52 of sleeve 40 to limit the forward movement of the outer sleeve 40 with respect to the intermediate ball keeper sleeve 26.

Figure 12:
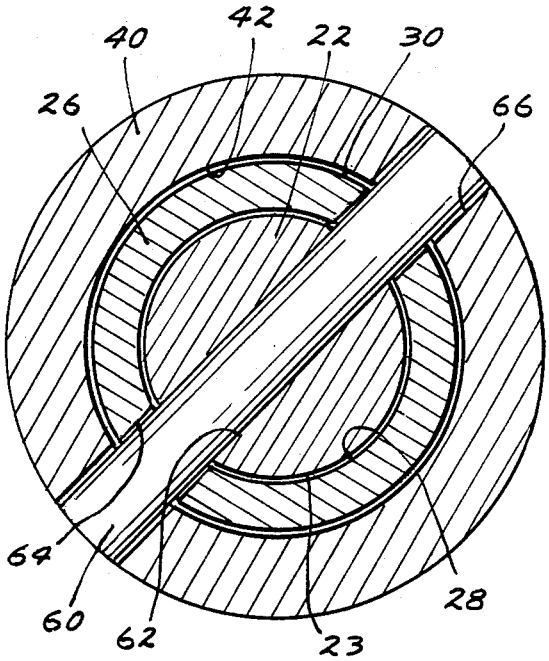
FIG. 12 is a vertical sectional view taken on the line 12—12 in FIG. 3.

As perhaps best seen in FIG. 12, a sleeve alignment and retaining pin 60 is force-fit through a provided opening 62 in cylindrical driver 22, and is freely slidably mounted in elongated longitudinally extending, movement limiting slots 64 and 66 in the ball keeper sleeve 26 and the outer sleeve 40, respectively.

Slots 64 and 66 are of approximately the same diameter as the retaining pin 60 so that, as the sleeves move, pin 60 in these slots prevents any appreciable rotational movement of the sleeves 26 and 40 with respect to the driver 22. The ends of the slots 64 and 66 in contacting pin 22 provide the limits of movement of the sleeves with respect to the driver. The rear end of movement limiting slot 64 in intermediate ball keeper sleeve 26 limits the outward movement of that sleeve to position approximately as seen in FIGS. 2 and 3, for example.

For reasons which will be apparent hereinafter, the inner compression coil spring 46 will be stronger and will resist movement of the ball keeper sleeve during the compression of the weaker outer compression coil spring 48 so that the outer sleeve 40 can be physically moved rearwardly with respect to the inner ball keeper sleeve 26 while maintaining the ball keeper sleeve at its outermost position as limited by a rear end of slot 64.

Operation of the First Form of the Invention

The operation of the structure of the first form of the invention is described herein as holding and driving nails 68 having shanks 69 and heads 70 into a wooden board 67. Heads 70 will have nominal predetermined diameters and will have maximum transverse dimensions no greater than the inner diameter of the inner cylindrical surface 28 of the ball keeper sleeve 26 and will have minimum transverse dimensions appreciably larger than the diameter of an imaginary circle concentric with the longitudinal axis of the driver shaft 14 and tangent to the innermost portions of the four nail head detaining balls 50 when those balls are extended their maximum distance through inner cylindrical surface 28 of ball keeper sleeve 26, as seen in FIG. 3.

When the driver assembly 10 of the first form of the invention is at rest, the parts will appear substantially as seen in FIG. 3 except that the nail 68 will not yet be in position. To load a nail, the artisan will position the impact hammer 12 against his body, for example, and, using one hand, will draw the outer cylindrical sleeve 40 back in the direction as shown in FIG. 2 by compressing outer compression coil spring 48 to bring the nail head detaining balls 50 into alignment with the detaining ball receiving detent cavities 51 in the outer cylindrical sleeve. At this point, the other hand can be used to insert a head 70 of a first nail 68 against the flat nail driving surface 24 of the cylindrical driver 22, pushing the detaining balls 50 into detent cavities 51 to accomplish this purpose.

Holding the nail in place, the outer sleeve is slowly released, and the outer compression coil spring 48 will move the outer sleeve 40 to position as seen in FIG. 3 with the forwardly facing shoulder 52 of the sleeve 40 resting against the snap ring 58. This movement initially forces balls 50 toward the center, and effectively detains or holds the nail head 70 in contact with the cylindrical driver 22 as seen in that figure.

The impact hammer 12 is then triggered to cause the driver shaft 14 and its cylindrical driver 22 to transmit the vibration or rapidly repeating impact forces from the hammer to the nail to drive it into the wooden board 67. In this process, the flat annular front end surface 54 of the outer sleeve 40 will be the first to contact the surface of the board 67, and will be forced by the board backwardly with respect to the intermediate sleeve 26. When this movement causes the detaining ball receiving detent cavities 51 to line up with the detaining balls 50 in the detaining ball receiving openings 38 in the ball keeper sleeve 26, the balls 50 will be forced back by the nail head 70 and by the driver 22 into the receiving detent cavities 51, as the nail 68 and driver 22 proceed toward the surface of the wooden board 67. This is the positioning of the parts as seen in FIG. 5, and the impact hammer will continue to be activated until the driver 22 forces the nail down as tight and is wanted into the wooden board.

When the nail has been driven into the board, the impact hammer will be deactivated and it and the driver assembly will be moved away from the wood block 67 and the nail head 70. At that time, the inner compression coil spring 46 will again force the intermediate ball keeper sleeve 26 outwardly to cause the retaining pin 60 to move to the limit of its travel in the movement limiting slot 64 in the ball keeper sleeve 26.

At this point, a second nail 68 can be loaded in the manner described above, and the cycle repeated.

Second Form of the Invention

In a second or modified form of the invention, a driver assembly 110 includes all of the functional parts as set out in connection with the first form of the invention, and all of these parts which are not modified are identically numbered. Driver assembly 112 includes a modified driver sleeve 112 which is provided with an elongated, longitudinally extending, movement limiting slot 164 in encompassing relationship to the sleeve alignment and retaining pin 60.

The driver 22 in the modified form of the invention is similar, but includes a forward portion 122 of relatively smaller diameter and a rearward portion 123 of relatively larger diameter, the junction between these portions providing a forwardly facing driver sleeve driving shoulder 125.

The driver sleeve 112 is defined by an inner cylindrical surface 113, a concentric outer cylindrical surface 114, a flat, annular rear end surface 116, and a flat annular front end surface 115. The size and configuration of the forward portion 122 of the driver 22 and of the driver sleeve 112 is such that the interior cylindrical surface 113 of the driver sleeve slides freely on the outer cylindrical surface 23 of the forward portion of the driver 22, and the outer cylindrical surface 114 of the driver sleeve 112 slides freely on the inner cylindrical surface 28 of the intermediate ball keeper sleeve 26.

As clearly seen in FIGS. 6, 8, 9 and 10, the length of the driver sleeve is such that its rear end surface 116 is in impact receiving driven relationship with respect to the forwardly facing shoulder 125 formed by the rearward portion 123 of the driver 122 when the front end surface 115 of driver sleeve 112 is flush with the nail driving surface 24 of the driver 22 so that these nail driving surfaces 24 and 115 are both in impact transmitting relationship to a head 70 of a nail to be driven, when the driver sleeve is so positioned on the driver.

Driver sleeve 112 is also provided with a plurality of dish-shape depressions, indentations or dimples 151 in its outer cylindrical surface 114, each positioned to be in alignment with one of the nail head detaining balls 50 when a flat, annular front end surface 115 lies in the same plane as the flat annular front end surface 53 of the intermediate ball keeper sleeve 26. See FIGS. 6, 7 and 12.

Operation of the Second Form of the Invention

Figure 6:
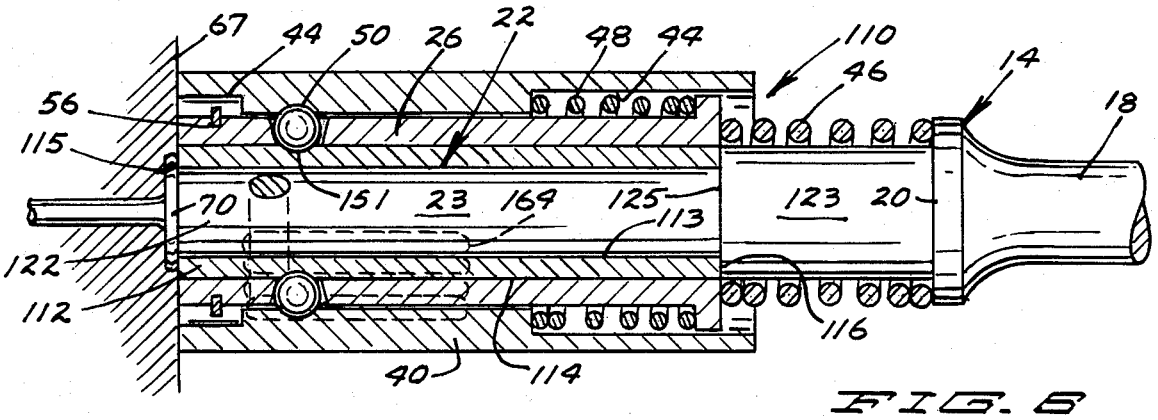
FIG. 6 is also an enlarged fragmentary horizontal sectional view taken as if on the line 2—2 in FIG. 1, but showing a second or modified form of the invention as the parts appear after a nail has been driven flush into the surface of the wood.

The positioning of the parts of the driver sleeve 112 of the second form of the invention as a first nail 68 has just been driven into the wooden board 67 is illustrated in FIG. 6. The nail head detaining balls 50 are situated partly in the detaining ball receiving detent cavities 51 of the outer cylindrical sleeve 40, partly within the detaining ball receiving openings 38 provided through the intermediate ball keeper sleeve 26, and partly in the dimples 151 provided in the driver sleeve 112.

Figure 7:
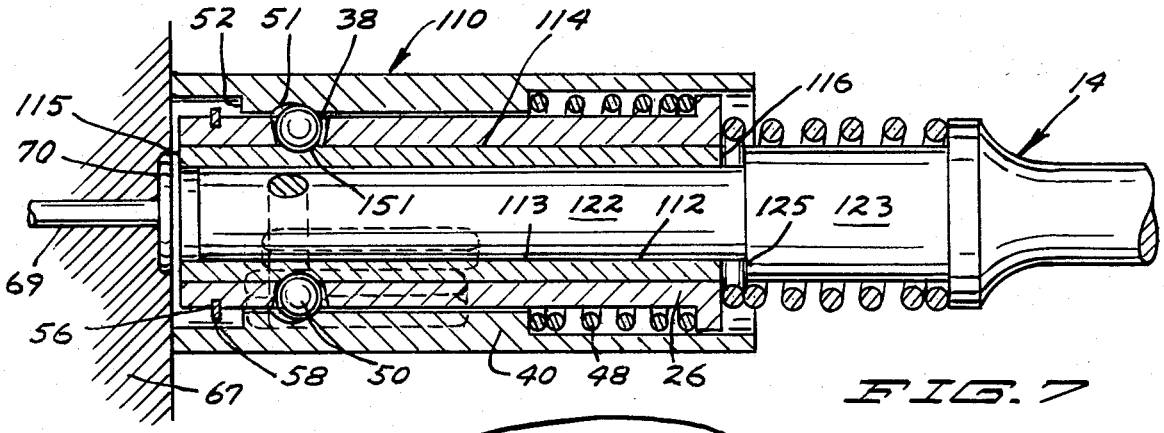
FIG. 7 is a fragmentary horizontal sectional view of the modified form as in FIG. 6 but with the parts positioned as they appear after the nail has been driven home and as the impact hammer and driver assembly are first being removed from the nail.
Figure 8:
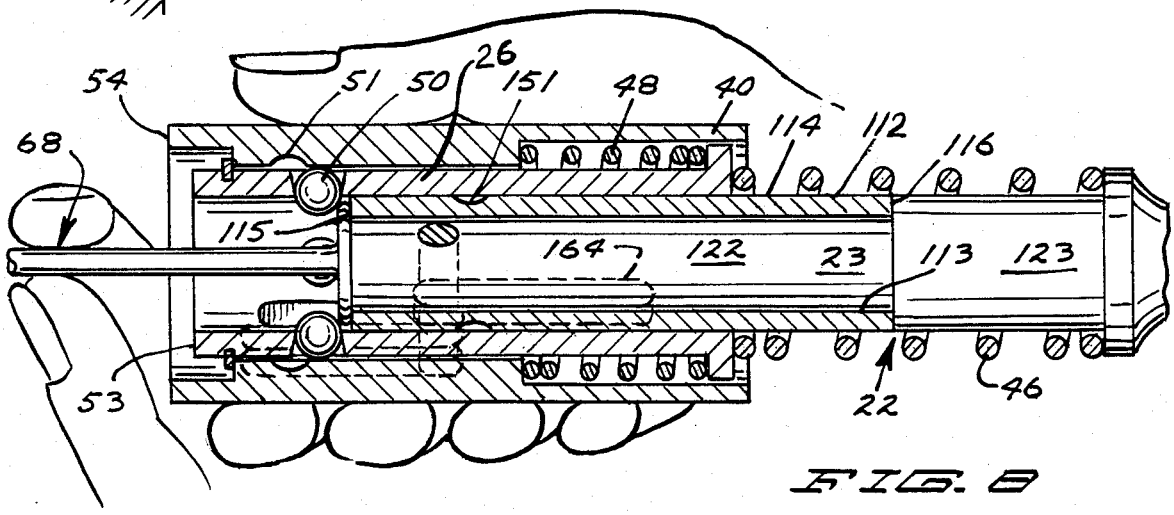
FIG. 8 is a fragmentary sectional view as in FIGS. 6 and 7 but with the parts positioned as they appear immediately after another nail has been inserted and is detained or fixedly held in the driver assembly.

After a nail 68 has been driven home into the wooden board 67, and as the impact hammer 12 and the driver sleeve 112 are first being withdrawn from the outer surface of the board 67, the outer compression coil spring 48, tending to move the outer cylindrical sleeve 40 in forward direction, will cause the outer sleeve to shift slightly toward the left as seen in FIGS. 7 and 8 until such time as the trailing edge of the detaining ball receivinfg detent cavities 51 push the nail head detaining balls or bolts 50 firmly down into the dish-shape depressions, indentations or dimples 151. This creates a drag on the driver sleeve 112 tending to hold it in position with respect to the intermediate ball keeper sleeve 26, and to let the forward portion 122 of the cylindrical driver 22 slide freely in rearward direction with respect to both the intermediate sleeve 26 and the driver sleeve 112 as the inner compression coil spring 46 forces the ball keeper sleeve forwardly and the cylindrical driver rearwardly with respect to each other. When the inner spring 46 has moved the cylindrical driver 22 and consequently the sleeve alignment and retaining pin 60 to the rearward end of the movement limiting slot 64 in the intermediate ball keeper sleeve 26, the cylindrical driver 22 and its forward portion 122 will have position as seen in FIG. 8 while the driver sleeve 112, the intermediate sleeve 26, the outer sleeve 40, and the nail head detaining balls 50 will still have position as seen in FIG. 7. At this point, the driver assembly 110 is "cocked" to receive a second nail 68.

A second nail 68 is positioned against the flat, annular front end surface 115 of the driver sleeve 112 in the same relative position of these two elements as is seen in FIG. 7, and, by holding the outer sleeve 40 in one hand, and the shank 69 of the nail 68 between the fingers, nail head 70 is forced against driver sleeve 112 with sufficient force to cause the balls 50 to be forced out of the dimples 151 and back into their detent cavities 51 so as to allow the driver sleeve 112 to move rearwardly of the ball keeper sleeve. This movement is continued until the front end surface 115 of the driver sleeve and the nail head 70 both pass under the balls 50. The pressure of outer compression coil spring 48 tending to move outer sleeve 40 in forward direction with respect to the intermediate sleeve 26 will cause the trailing surfaces of detaining ball receiving cavities 51 in sleeve 40 to force the balls inwardly and clear of the inner cylindrical surface 42 of outer sleeve 40, thus allowing sleeve 40 to move forwardly with respect to the intermediate ball keeper sleeve 26 until its forwardly facing shoulder 52 comes in contact with the snap ring 58. This traps the balls in their forwardmost position against the minimum diameter of the detaining ball receiving openings in the ball keeper sleeve, thus coming into detaining or holding relationship with the underside of the nail head 70, all as seen in FIG. 8.

Figure 9:
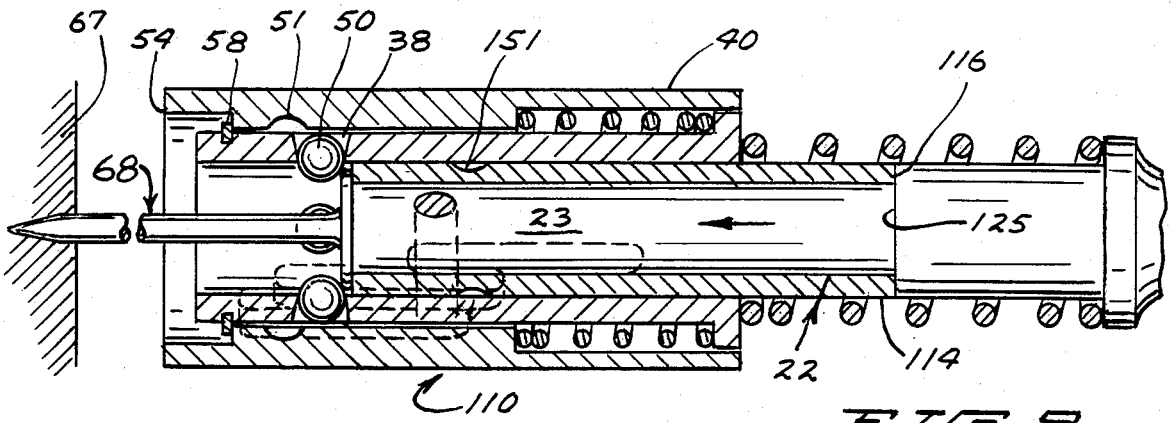
FIG. 9 is a fragmentary horizontal sectional view as in FIG. 6 but with the parts positioned as the second nail is being driven into the board.

With the nail head 70 in contact with the front end surface 115 of the driver sleeve 112 and also in contact with the nail-driving surface 24 of the driver 22, the rear end surface 116 of the driver sleeve 112 is in contacting driving relationship with the forwardly facing driver sleeve driving shoulder 125 of the cylindrical driver. Thus, and as seen in FIG. 9, the impact hammer 12 can be activated to begin driving the second nail 68 into the board 67, with the nail head 70 being firmly positioned against those driving surfaces during the initial driving of the nail into the board.

Figure 10:
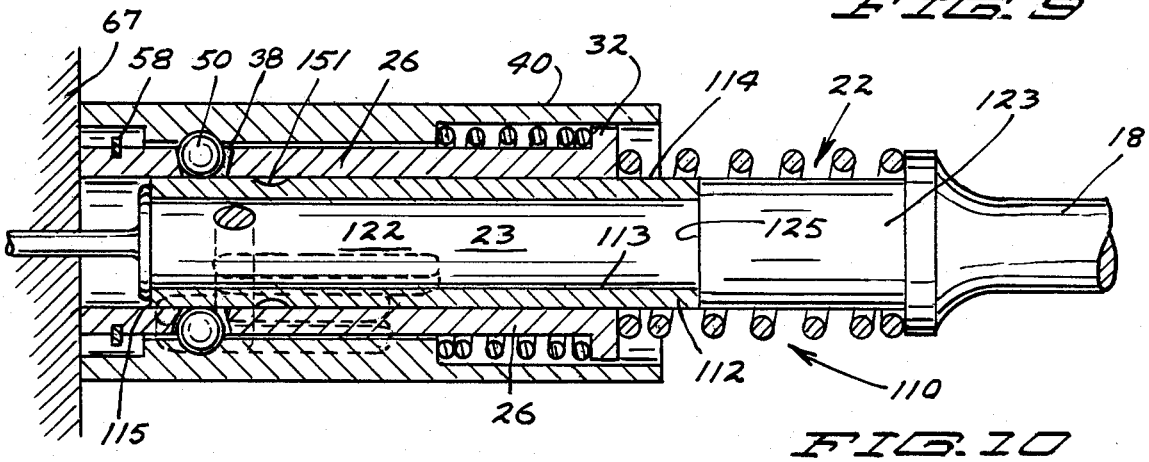
FIG. 10 is a fragmentary horizontal sectional view as in FIG. 6 but with the parts shown after the nail has been released by the nail detaining balls and just before it is finally driven home into the board.
Figure 11:
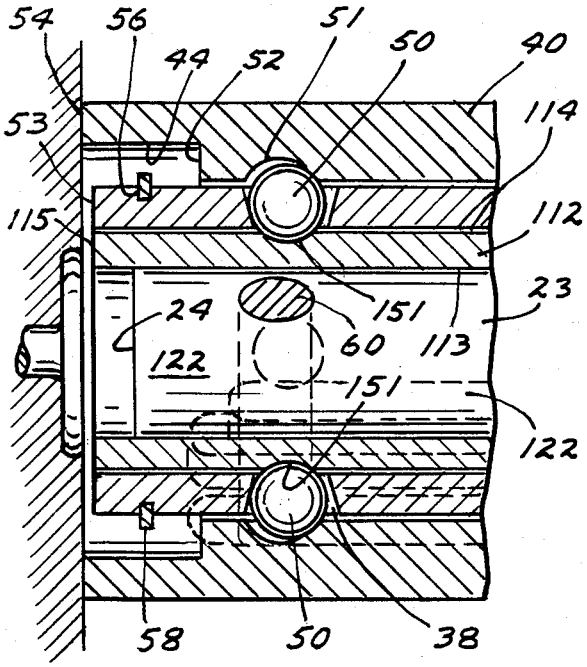
FIG. 11 is an enlarged fragmentary sectional view of a portion of the driver assembly with parts positioned as seen in FIG. 7.

Then, as the annular front end surface 54 of the outer sleeve 40 first comes in contact with the board 67, the intermediate ball keeper sleeve 26 continues its forward movement until such time as the balls 50 in the detaining ball receiving openings 38 of the intermediate sleeves are aligned with the detent cavities 51 in the outer sleeve. At this point, the nail head 70 and the outer periphery of the driver sleeve 112 force the balls back into the detent openings, allowing the driver sleeve and the driver to proceed past the balls 50 to the position as seen in FIG. 10 which is immediately before the second nail is driven home to position as seen in FIG. 6.

At that point, the process can be repeated with respect to a third nail.

Although the present invention has been described with reference to preferred embodiments, workers skilled in the art will recognize that changes may be made in form and detail without departing from the spirit and scope of the invention.

I claim:

1. For use with an impact hammer, a driver assembly for holding and driving nails having heads of predetermined transverse dimension, said driver assembly including:

A. a driver shaft operably associated with the impact hammer to receive and transmit hammer-action blows from the hammer, said driver shaft having:
   (1) an elongated impact hammer-engaging shank having a rear end portion supported in said impact hammer,
   (2) an elongated driver integrally connected to, extending forwardly from, and concentric with said shank and having a nail driving surface at a front end thereof, said nail driving surface lying in perpendicular relation to a longitudinal axis of the driver shaft;

B. an intermediate bolt keeper sleeve slidably mounted in encompassing relation to the driver, said bolt keeper sleeve being partially defined by elongated, mutually parallel inner and outer surfaces;

C. an outer sleeve slidably and concentrically mounted on the bolt keeper sleeve, said outer sleeve being partially defined by an elongated inner surface parallel to, and in sliding contact with the bolt keeper sleeve outer surface;

D. first bias means operative on the driver shaft and on the bolt keeper sleeve to bias the bolt keeper sleeve to tend to move along the driver in forward direction;

E. second bias means operative on the outer sleeve and on the bolt keeper sleeve to bias the outer sleeve to tend to move along the bolt keeper sleeve in forward direction;

F. said bolt keeper sleeve being provided with at least one detaining bolt receiving opening extending radially therethrough, on a radial axis lying in perpendicular relation to and passing through the longitudinal axis of the driver shaft;

G. at least one round ended nail head detaining bolt situated in said bolt receiving opening, the minimum dimension of said bolt receiving opening being at the bolt keeper sleeve inner surface and being less than the maximum transverse dimension of the bolt therein;

H. the dimensions and configuration of the bolt, the thickness of the bolt keeper sleeve and the minimum dimension of the keeper sleeve bolt receiving opening being such that the outermost surface of the bolt will be substantially flush with said bolt keeper sleeve outer surface and the innermost surface of the bolt will lie on the periphery of an imaginary circle, concentric with the driver shaft and of lesser diameter than the predetermined dimension of the heads of the nails to be held and driven when the bolt protrudes as far as possible through the inner surface of the bolt keeper sleeve;

I. the outer sleeve and the bolt keeper sleeve each being partially defined by annular front end surfaces lying in planes perpendicular to said driver shaft axis, said outer sleeve being provided with at least one detaining bolt receiving detent cavity open through its inner surface and positioned to be in alignment with said detent bolt receiving opening in said bolt keeper sleeve when said front end surfaces of said outer and intermediate sleeves lie in a common plane, the size and shape of said outer sleeve detent cavity being such that the detaining bolt, when aligned with its detent cavity, can be snugly fitted into said cavity to lie entirely outside of the bolt keeper sleeve inner surface.

2. The driver assembly of claim 1 wherein:

J. means is provided to prevent rotation of the outer sleeve, the bolt keeper sleeve and the driver sleeve with respect to each other.

3. The driver shaft of claim 2 wherein:

K. means is provided to limit the forward movement of the bolt keeper sleeve with respect to the driver.

4. The driver assembly of claim 3 wherein:

L. said means to limit movement of the sleeves with respect to each other and with respect to the driver includes a sleeve alignment and retaining pin fixedly mounted in and extending outwardly from the driver and having an axis perpendicular to and passing through the longitudinal axis of the driver shaft.

5. The driver assembly of claim 3 wherein:

L. means for limiting the forward movement of the outer sleeve with respect to the bolt keeper sleeve includes a front portion of the outer sleeve, and a stop ring extending outwardly from a front end portion of the ball keeper sleeve.

6. The driver assembly of claim 1 wherein:

J. a driver sleeve is situated in free sliding relationship with respect to the interior surface of the ball keeper sleeve and in free sliding relationship with respect to the outer surface of the driver, said driver sleeve being defined by elongated, mutually prallel outer and inner surfaces in sliding contact with the inner surface of the bolt keeper sleeve and the outer surface of the driver, respectively, and by mutually parallel, annular front end and rear end surfaces lying in planes perpendicular to said driver shaft axis;

K. said driver being provided with a forwardly facing driver sleeve driving shoulder, the length of said driver sleeve and the positioning of said driving shoulder being such that when said rear end surface of said driver sleeve is in contact with said forwardly facing driving shoulder, said front end surface of said driver sleeve and the front end surface of said driver will lie in the same plane;

L. the driver sleeve being provided with at least one nail head detaining bolt receiving indentation positioned to be in alignment with said detaining bolt when the front end surfaces of said bolt keeper sleeve and said driver sleeve are in the same plane, said indentation being sufficiently deep to restrain longitudinal movement of said driver sleeve with respect to said bolt keeper sleeve when said detaining bolt is aligned with said detent cavity in said outer sleeve and with said indentations in said driver sleeve and said bolt, being in said detent cavity and said bolt receiving opening, is preventing movement of said outer sleeve forwardly with respect to said bolt keeper sleeve against the action of said second bias means, said indentations being of size and configuration to push said detaining balls back into said detent cavities and out of said indentations when forced to move longitudinally by insertion of the head of a nail to be held and driven.

7. For use with an impact hammer, a driver assembly for holding and driving nails having heads with transverse diameters of predetermined dimension, said driver assembly including:

A. a driver shaft operably associated with the impact hammer to receive and transmit hammer-action blows from the hammer, said driver shaft having:
(1) an impact hammer-engaging shank having a rear end portion supported in said impact hammer, said shank providing a forwardly facing spring-engaging shoulder,
(2) a cylindrical driver integrally connected to and concentric with said shank and having a nail driving surface at a front end thereof, said nail driving surface lying in perpendicular relation to a longitudinal axis of the driver shaft;

B. an intermediate ball keeper sleeve concentrically and slidably mounted in encompassing relation to the driver, said ball keeper sleeve being partially defined by concentric inner and outer cylindrical surfaces and including an outwardly extending collar providing a forwardly facing spring-engaging shoulder at a rear end portion thereof;

C. an outer sleeve slidably and concentrically mounted on the ball keeper sleeve, said outer sleeve being partially defined by an inner cylindrical surface in sliding contact with the ball keeper sleeve outer cylindrical surface, said outer sleeve being provided with a rearwardly facing spring-engaging shoulder extending outwardly from its cylindrical surface at an intermediate portion of said outer sleeve;

D. an inner compression coil spring around the driver and bearing on the driver shaft shank shoulder and on the ball keeper sleeve to bias the ball keeper sleeve to tend to move along the driver in forward direction;

E. an outer compression coil spring around the ball keeper sleeve and bearing on the rearwardly facing shoulder of the outer sleeve and the forwardly facing shoulder of the ball keeper sleeve collar to bias the outer sleeve to tend to move along the ball keeper sleeve in forward direction;

F. said ball keeper sleeve being provided with a plurality of detaining ball receiving openings extending radially therethrough, the radial axes of all of said openings lying in a single plane in perpendicular relation to the longitudinal axis of the driver assembly;

G. a plurality of nail head detaining balls, each being situated in one of said ball receiving openings, the minimum diameter of each of said ball receiving openings being at the ball keeper sleeve inner cylindrical surface and being less than the diameter of the ball therein;

H. the diameter of the balls, the thickness of the ball keeper sleeve and the minimum diameter of the keeper sleeve ball receiving openings being such that the outermost surface of the balls will be substantially flush with said ball keeper sleeve outer cylindrical surface and the innermost surface of the balls will lie on the periphery of an imaginary circle of lesser diameter than the predetermined diameter of the heads of the nails to be held and driven when the balls protrude as far as possible through the inner cylindrical surface of the ball keeper sleeve;

I. the outer sleeve and the ball keeper sleeve each being partially defined by annular front end surfaces lying in planes perpendicular to said driver shaft axis, said outer sleeve being provided with detaining ball receiving detent cavities open through its inner cylindrical surface and positioned to be in alignment with said detent ball receiving openings in said ball keeper sleeve when said front end surfaces of said outer and intermediate sleeves lie in a common plane, the size and shape of said outer sleeve detent cavities being such that each detaining ball, when aligned with its detent cavity, can be snugly fitted into said cavity to lie entirely outside of the ball keeper sleeve inner cylindrical surface.

8. The driver assembly of claim 2 wherein:

J. means is provided to prevent rotation of the outer sleeve with respect to the ball keeper sleeve.

9. The driver assembly of claim 8 wherein:

K. means is provided to limit the forward movement of the ball keeper sleeve with respect to the driver.

10. The driver assembly of claim 9 wherein:

L. said means to prevent rotation of the outer sleeve and the ball keeper sleeve with respect to each other and said means to limit movement of the sleeves with respect to each other and with respect to the driver includes a sleeve alignment and retaining pin fixedly mounted in and extending outwardly from the driver and having an axis perpendicular to and passing through the longitudinal axis of the driver shaft.

11. The driver assembly of claim 9 wherein:

L. means for limiting the forward movement of the outer sleeve with respect to the ball keeper sleeve includes a forwardly facing shoulder provided on the outer sleeve at a front portion but spaced from the front end of the outer sleeve, and a stop ring extending outwardly from a front end portion of the ball keeper sleeve.

12. The driver assembly of claim 2 wherein:

J. a driver sleeve is situated in free sliding relationship with respect to the inner surface of the ball keeper sleeve and in free sliding relationship with respect to the outer surface of the driver, said driver sleeve being defined by outer and inner concentric cylindrical surfaces in sliding contact with the inner surface of the ball keeper sleeve and the outer surface of the driver, respectively, and by mutually parallel, annular front end and rear end surfaces lying in planes perpendicular to said driver shaft axis;

K. said driver shaft being provided with a forwardly facing driver sleeve driving shoulder, the length of said driver sleeve and the positioning of said driver sleeve driving shoulder being such that when said rear end surface of said driver sleeve is in contact with said forwardly facing driving shoulder, said front end surface of said driver sleeve and the front end surface of said driver will lie in the same plane;

L. the driver sleeve being provided with a plurality of nail head detaining ball receiving indentations positioned to be in alignment with said detaining balls when the front end surfaces of said ball keeper sleeve and said driver sleeve are in the same plane, said indentations being sufficiently deep to restrain longitudinally movement of said driver sleeve with respect to said ball keeper sleeve when said detaining balls are aligned with said detent cavities in said outer sleeve and with said indentations in said driver sleeve and said balls, being in said detent cavities and ball receiving openings, are preventing movement of said outer sleeve forwardly with respect to said ball keeper sleeve against the action of said outer spring, said indentations being of size and configuration to push said detaining balls back into said detent cavities and out of said indentations when forced to move longitudinally by insertion of the head of a nail to be held and driven.

13. For use with an impact hammer, a driver assembly for holding and driving nails having heads of predetermined transverse dimension, said driver assembly including:

A. a driver shaft operably associated with the impact hammer to receive and transmit hammer-action blows from the hammer, said driver shaft having:
(1) an elongated impact hammer-engaging shank having a rear end portion supported in said impact hammer, said shank providing a forwardly facing spring-engaging shoulder,
(2) an elongated driver integrally connected to, extending forwardly from, and concentric with said shank and having a nail driving surface at a front end thereof, said nail driving surface lying in perpendicular relation to a longitudinal axis of the driver shaft;

B. an intermediate bolt keeper sleeve slidably mounted in encompassing relation to the driver, said bolt keeper sleeve being partially defined by elongated, mutually parallel inner and outer surfaces and including an outwardly extending collar providing a forwardly facing spring-engaging shoulder at a rear end portion thereof;

C. an outer sleeve slidably and concentrically mounted on the ball keeper sleeve, said outer sleeve being partially defined by an elongated inner surface parallel to, and in sliding contact with the bolt keeper sleeve outer surface, said outer sleeve being provided with a rearwardly facing spring-engaging shoulder extending outwardly from its inner surface;

D. an inner compression coil spring around the driver and bearing on the driver shaft shank shoulder and on the bolt keeper sleeve to bias the bolt keeper sleeve to tend to move along the driver in forward direction;

E. an outer compression coil spring around the bolt keeper sleeve and bearing on the rearwardly facing shoulder of the outer sleeve and the forwardly facing shoulder of the bolt keeper sleeve collar to bias the outer sleeve to tend to move along the bolt keeper sleeve in forward direction;

F. said bolt keeper sleeve being provided with a plurality of detaining bolt receiving openings extending radially therethrough, the radial axes of all of said openings lying in a common plane in perpendicular relation to the longitudinal axis of the driver shaft;

G. a plurality of round ended nail head detaining bolts, each being situated in one of said bolt receiving openings, the minimum dimension of each of said bolt receiving openings beinhg at the bolt keeper sleeve inner surface and being less than the maximum transverse dimension of the bolt therein;

H. the dimensions of the bolts, the thickness of the bolt keeper sleeve and the minimum dimension of the keeper sleeve bolt receiving openings being such that the outermost surface of the bolts will be substantially flush with said bolt keeper sleeve outer surface and the innermost surface of the bolts will lie on the periphery of an imaginary circle of lesser diameter than the predetermined dimension of the heads of the nails to be held and driven when the bolts protrude as far as possible through the inner surface of the bolt keeper sleeve;

I. the outer sleeve and the bolt keeper sleeve each being partially defined by annular front end surfaces lying in planes perpendicular to said driver shaft axis, said outer sleeve being provided with detaining bolt receiving detent cavities open through its inner surface and positioned to be in alignment with said detent bolt receiving openings in said bolt keeper sleeve when said front end surfaces of said outer and intermediate sleeves lie in a common plane, the size and shape of said outer sleeve detent cavities being such that each detaining bolt, when aligned with its detent cavity, can be snugly fitted into said cavity to lie entirely outside of the bolt keeper sleeve inner surface.

14. The driver assembly of claim 13 wherein:

J. means is provided to prevent rotation of the outer sleeve, the bolt keeper sleeve and the driver sleeve with respect to each other.

15. The driver shaft of claim 14 wherein:

K. means is provided to limit the forward movement of the bolt keeper sleeve with respect to the driver.

16. The driver assembly of claim 15 wherein:

L. said means to limit movement of the sleeves with respect to each other and with respect to the driver includes a sleeve alignment and retaining pin fixedly mounted in and extending outwardly from the driver and having an axis perpendicular to and passing through the longitudinal axis of the driver shaft.

17. The driver assembly of claim 15 wherein:

L. means for limiting the forward movement of the outer sleeve with respect to the bolt keeper sleeve includes a forwardly facing shoulder provided on the outer sleeve at a front portion but spaced from the front end of the outer sleeve, and a stop ring extending outwardly from a front end portion of the ball keeper sleeve.

18. The driver assembly of claim 13 wherein:

J. a driver sleeve is situated in free sliding relationship with respect to the interior surface of the bolt keeper sleeve and in free sliding relationship with respect to the outer surface of the driver, said driver sleeve being defined by elongated, mutually parallel outer and inner surfaces in sliding contact with the inner surface of the bolt keeper sleeve and the outer surface of the driver, respectively, and by mutually parallel, annular front end and rear end surfaces lying in planes perpendicular to said driver shaft axis;

K. said driver being provided with a forwardly facing driver sleeve driving shoulder, the length of said driver sleeve and the positioning of said driver sleeve driving shoulder being such that when said rear end surface of said driver sleeve is in contact with said forwardly facing driving shoulder, said front end surface of said driver sleeve and the front end surface of said driver will lie in the same plane;

L. the driver sleeve being provided with a plurality of nail head detaining bolt receiving indentations positioned to be in alignment with said detaining bolts when the front end surfaces of said bolt keeper sleeve and said driver sleeve are in the same plane, said indentations being sufficiently deep to restrain longitudinal movement of said driver sleeve with respect to said bolt keeper sleeve when said detaining bolts are aligned with said detent cavities in said outer sleeve and with said indentations in said driver sleeve and said bolts, being in said detent cavities and bolt receiving openings, are preventing movement of said outer sleeve forwardly with respect to said bolt keeper sleeve against the action of said outer spring, said indentations being of size and configuration to push said detaining bolts back into said detent cavities and out of said indentations when forced to move longitudinally by insertion of the head of a nail to be held and driven.

* * * * *

UNITED STATES PATENT AND TRADEMARK OFFICE

CERTIFICATE OF CORRECTION

PATENT NO. : 4,519,536

DATED : May 28, 1985

INVENTOR(S) : William A. Steigauf

It is certified that error appears in the above-identified patent and that said Letters Patent is hereby corrected as shown below:

Column 12, Claim 8, line 1, "2" should be --7--.

Column 12, Claim 12, line 1, "2" should be --7--.

Column 14, Claim 13, line 4, "beinhg" should be --being--.

Signed and Sealed this

*Third* Day of *September 1985*

[SEAL]

*Attest:*

DONALD J. QUIGG

*Attesting Officer* *Acting Commissioner of Patents and Trademarks - Designate*